US006418596B2

(12) United States Patent
Haas

(10) Patent No.: US 6,418,596 B2
(45) Date of Patent: Jul. 16, 2002

(54) SEAT BELT BUCKLE

(75) Inventor: Peter Haas, Göggingen (DE)

(73) Assignee: TRW Occupant Restraint Systems GmbH & Co. KG, Alfdorf (DE)

( * ) Notice: Subject to any disclaimer, the term of this patent is extended or adjusted under 35 U.S.C. 154(b) by 0 days.

(21) Appl. No.: 09/754,810

(22) Filed: Jan. 4, 2001

(30) Foreign Application Priority Data

Jan. 19, 2000 (DE) ..... 200 00 869

(51) Int. Cl.[7] ..... A44B 11/14
(52) U.S. Cl. ..... 24/639; 24/642; 24/640
(58) Field of Search ..... 24/633, 639, 640, 24/642, 641, 637, 194; 297/468, 480

(56) References Cited

U.S. PATENT DOCUMENTS 3,955,056 A * 5/1976 Lindblad ..... 24/639 X
4,566,161 A * 1/1986 Ashworth et al. ..... 24/642
4,597,141 A * 7/1986 Wier ..... 24/633
4,621,394 A * 11/1986 Wier ..... 24/642
4,802,266 A 2/1989 Doty et al.
4,998,328 A * 3/1991 Tanaka ..... 24/639
5,067,212 A * 11/1991 Ellis ..... 24/642
5,596,795 A * 1/1997 Beisswenger ..... 24/633
5,765,266 A * 6/1998 Betz ..... 24/633

* cited by examiner

*Primary Examiner*—Robert J. Sandy
(74) *Attorney, Agent, or Firm*—Tarolli, Sundheim, Covell, Tummino & Szabo L.L.P.

(57) ABSTRACT

A seat belt buckle having a release button for a latch slidably mounted on a frame, an ejector for an insert tongue and at least one connecting element. The connecting element is shiftable between a working position, in which it makes a connection between the ejector and the release button, and a resting position in which it breaks the connection between the ejector and release button. A dislocator is provided on the frame, which dislocates the connecting element from the resting position into the working position when the ejector is shifted out of place.

4 Claims, 7 Drawing Sheets

SEAT BELT BUCKLE

FIELD OF THE INVENTION

The invention relates to a seat belt buckle comprising a release button for a latch slidably mounted on a frame, and an ejector for an insert tongue.

BACKGROUND OF THE INVENTION

Known from DE 296 13 690 is one such buckle provided with a balance weight to prevent the release button from shifting out of place relative to the buckle when exposed to a heavy acceleration or deceleration in the longitudinal direction of the buckle due to its mass inertia and thus opening the buckle unintentionally. Inspite of this, unintentional opening may occur with this type of buckle when, for instance, the buckle is heavily accelerated by a belt tensioner and then abruptly decelerated on impacting a stopper. Since the belt tensioner has a certain clearance with respect to the release button it still has an impulse when the release button is already at rest. Since, however, the ejector needs to be mechanically coupled to the release button so that it is able to activate the latch on insertion of the insert tongue, this impulse is passed on via the ejector to the release button. At the point in time of impulse transfer, however, the compensation of the inertia by the balancing weight is no longer effective, since this is likewise at rest. When the impulse transmitted is sufficiently large there is thus the risk of the release button being shifted out of place, thus opening the buckle.

The invention provides a seat belt buckle in which with the insert tongue inserted any impulse transfer from the insert tongue to the release button is reliably prevented.

BRIEF DESCRIPTION OF THE INVENTION

This is achieved with a seat belt buckle comprising a release button for a latch slidably mounted on a frame, an ejector for an insert tongue and at least one connecting element, the connecting element being shiftable between a working position, in which it makes a connection between the ejector and the release button, and a resting position in which it breaks the connection between the ejector and release button, a dislocator being provided on the frame which dislocates the connecting element from the resting position into the working position when the ejector is shifted out of place. Coupling only takes place when necessary, namely on insertion of the insert tongue, thus reliably preventing any impulse transfer from the insert tongue to the release button with the insert tongue inserted.

In accordance with the preferred embodiment of the invention the connecting element consists of a shifter formed on the ejector, and the dislocator is configured as a ramp on the frame on which the shifter slides when the ejector is shifted out of place and the length of the ramp is selected so that at the end of the shifting travel of the ejector the shifter is released from the ramp to fall back into its resting position. Compared to conventional buckles, this embodiment provides the advantage that no additional components are required. Only the configuration of two components, namely frame and ejector, needs to be modified.

Further advantages and features of the invention read from the following description of the preferred embodiment and are evident from the attached drawings to which reference is made and in which:

DETAILED DESCRIPTION OF A PREFERRED EMBODIMENT

Figure 1:
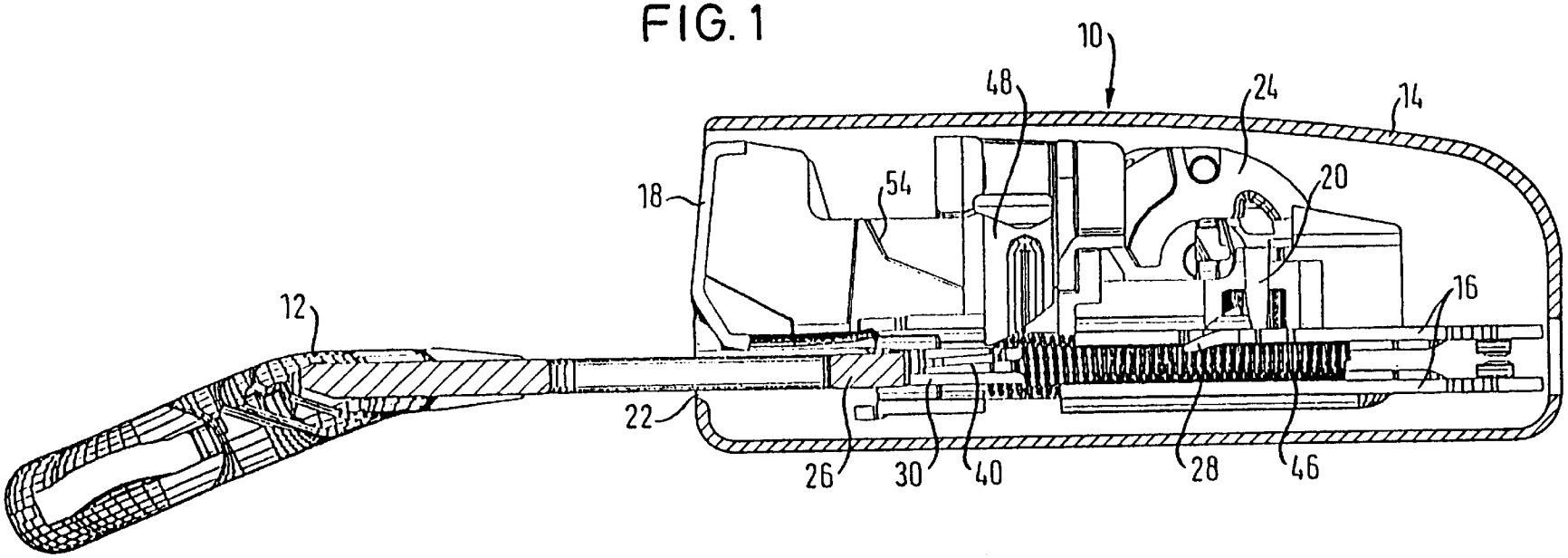
FIG. 1 is a cross-section through a buckle including an insert tongue in accordance with the preferred embodiment of the invention.

Referring now to FIG. 1 there is illustrated a buckle 10 in accordance with the invention and a matching insert tongue 12. The buckle 10 includes a housing 14 and a frame 16. Shiftably guided on the frame 16 is a release button 18. The release button 18 is provided with two slaved pins 20, only one of which is evident in the Figure. Provided at the front side (on the left in the Figure) of the buckle 10 in the housing 14 is an insertion opening 22 into which the insert tongue 12 is insertable. The buckle is in addition provided with a device 24 preventing the release button 18 from shifting out of place when exposed to a heavy acceleration, for instance, on activation of a belt tensioner, due to its own inertial mass relative to the frame 16. This device 24 may be of the kind as detailled in DE 296 13 690. The configuration and functioning of the device 24 is irrelevant to describing the present invention, this being the reason why no details are given thereof in the present.

Figure 2:
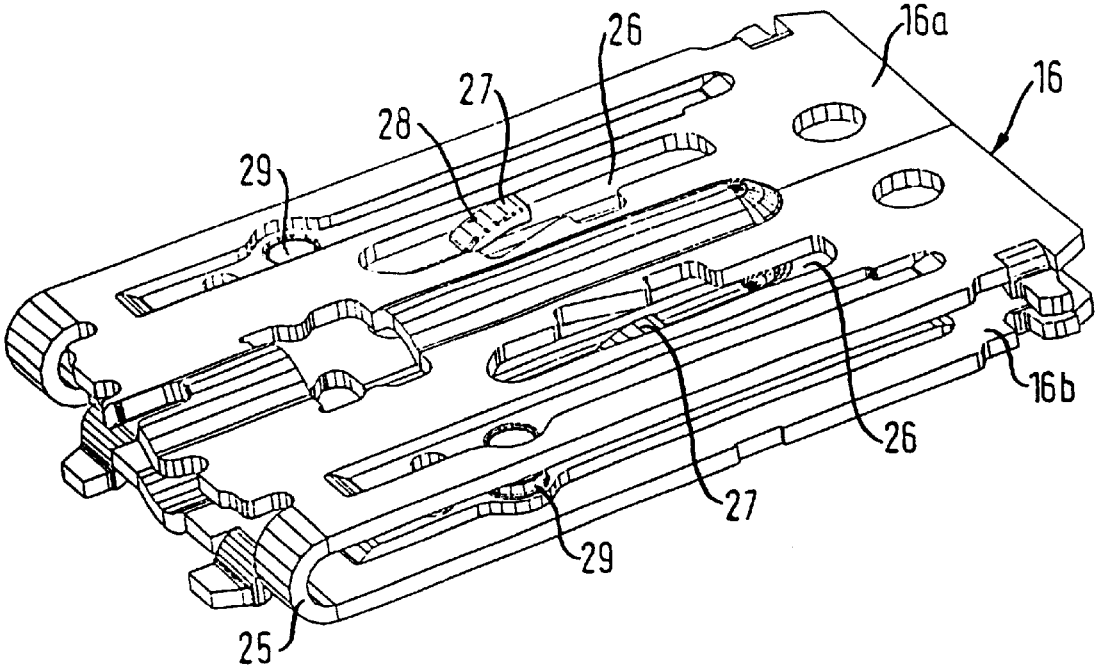
FIG. 2 is an isometric view of a first component of the buckle as shown in FIG. 1.

Referring now to FIG. 2 there is illustrated the frame 16 consisting subtantially of two parallel plates 16*a*, 16*b*. The frame may be stamped to advantage from a metal sheet upswept in the middle transversely to its longitudinal extent so that the two parallel sheet metal halves as plates 16*a*, 16*b* form an interspace and are joined at the front side via U-shaped webs 25. Stamped out in the upper plate 16*a* are two parallel slots 26, a dislocator in the form of a key 27 protruding from the outer longitudinal side of each slot into the slot 26. The portion of this key 27 pointing to the front side of the frame 16 is downswept into the interspace between the two plates 16*a*, 16*b* and forms as viewed from the front side of the frame a ramp 28 leading from the interspace to the upper side of the upper plate 16*a*.

Stamped out from the plates 16*a*, 16*b* at surface areas facing each other are two cylindrical protuberances 29 each, extending into the interspace. In this arrangement each of the protuberances 29 of the upper plates 16*a* is located opposite a protuberance 29 of the lower plate 16*b* and is in contact therewith in the interspace.

Figure 3:
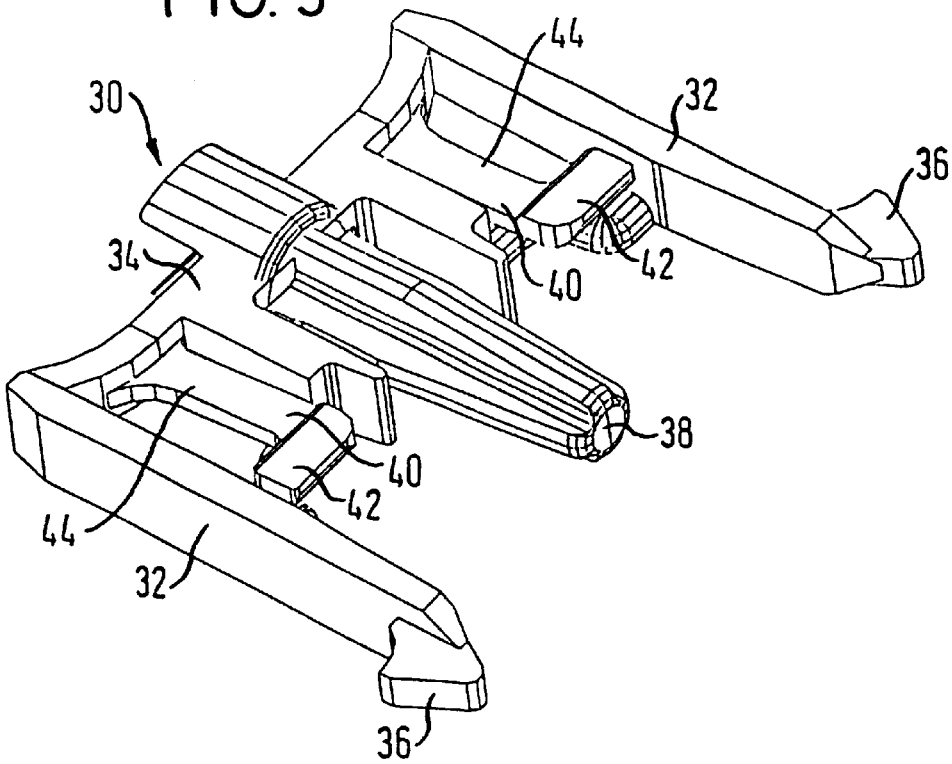
FIG. 3 is an isometric view of a second component of the buckle as shown in FIG. 1.

Referring now to FIG. 3 there is illustrated in detail an ejector 30 slidably mounted in the frame 16 for ejecting the insert tongue 12. The ejector 30 comprises two parallel arms 32 connected to each other by a web 34 at one of their ends. Configured at the other end of the arms 32 in each case is a hook 36 pointing outwards. Formed in the middle of the web 34 is a finger 38 parallel to the arms 32. Likewise formed on the arms 32 between the arms 32 and the finger 38 are two connecting elements in the form of pushers 40. Each pusher 40 consists of a buffer 42 oriented subtantially parallel to the web 34, the buffer 42 being connected to the web 34 by a slim member 44. The member 44 is oriented roughly in the direction of the arms 32 slightly inclined from a plane formed by the arms 32. Due to the flexure of its member 44 the pusher 40 can be bent from its resting position into a working position in which the buffer 42 protrudes between the upper plates 16*a* of the frame 16 (see FIG. 5). The ejector 30 is biased in the direction of the insertion opening 22 by a spring 46 mounted on the finger 38 (FIG. 1), it contacting the protuberances 29 with the hook 36 when the insert tongue 12 is not inserted. The ejector 30 may be fabricated cost-effectively as an injection molded plastics part. In this case the pusher 40 can be molded at no additional expense.

Figure 4:
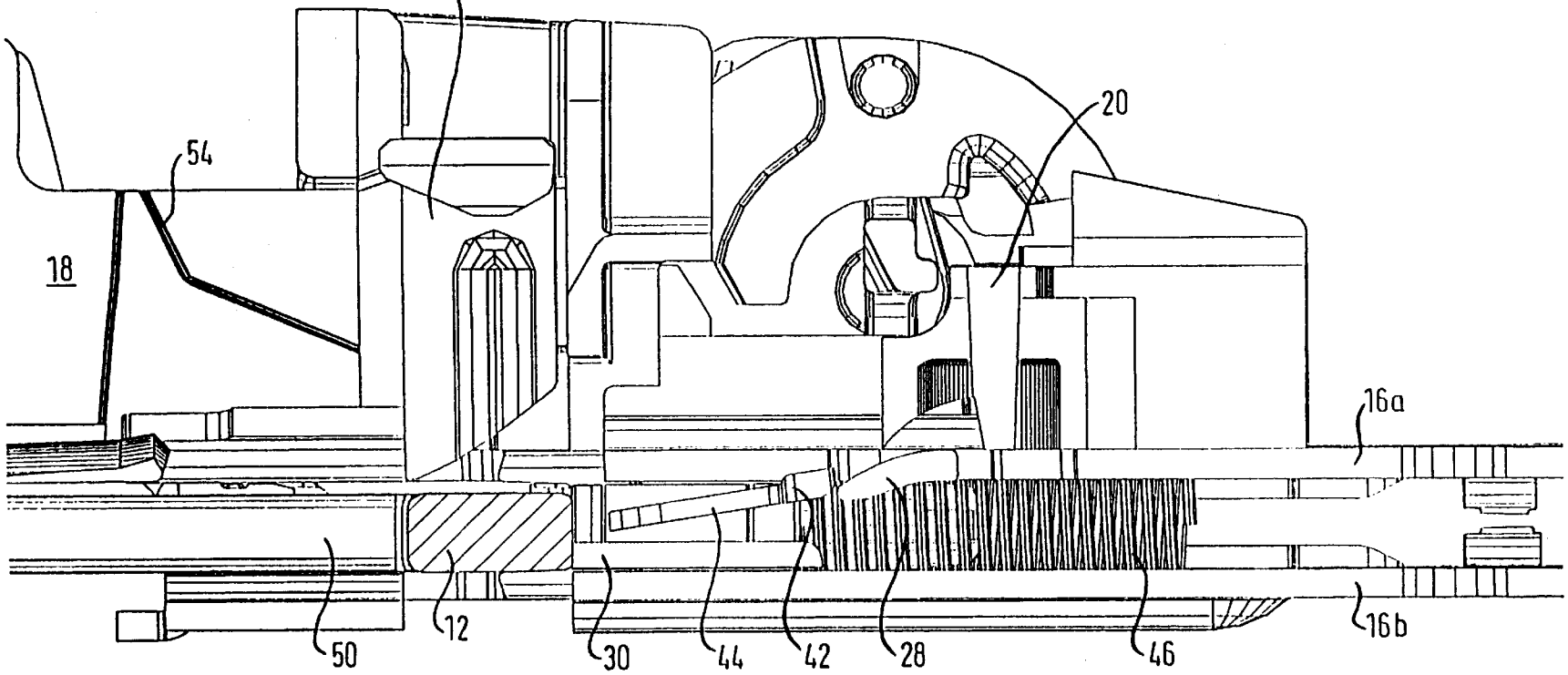
FIGS. 4 to 7 each illustrate a detail on a magnified scale of a cross-section through the buckle as shown in FIG. 1 in sequential phases of inserting the insert tongue.
Figure 5:
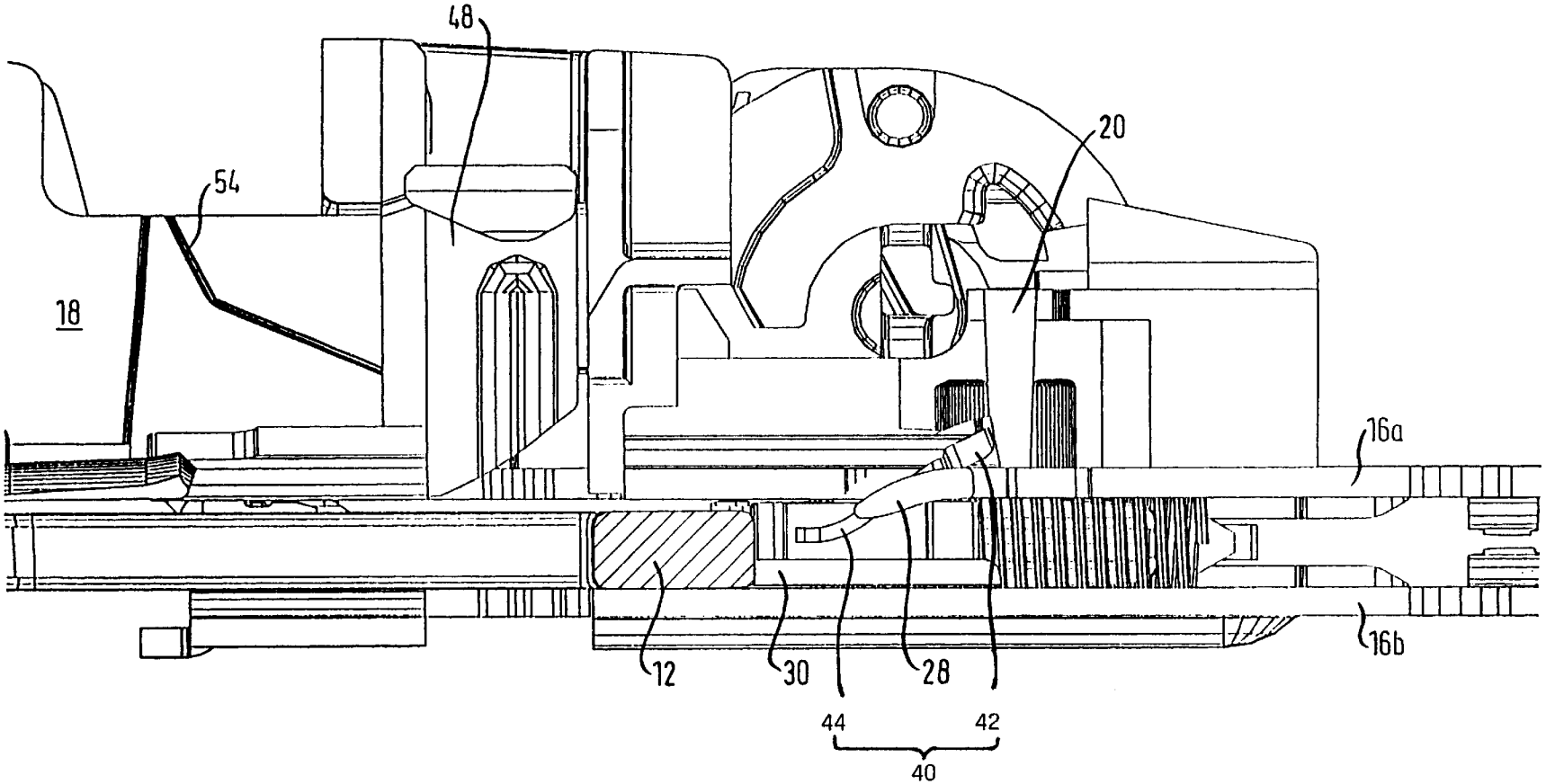
Figure 7:
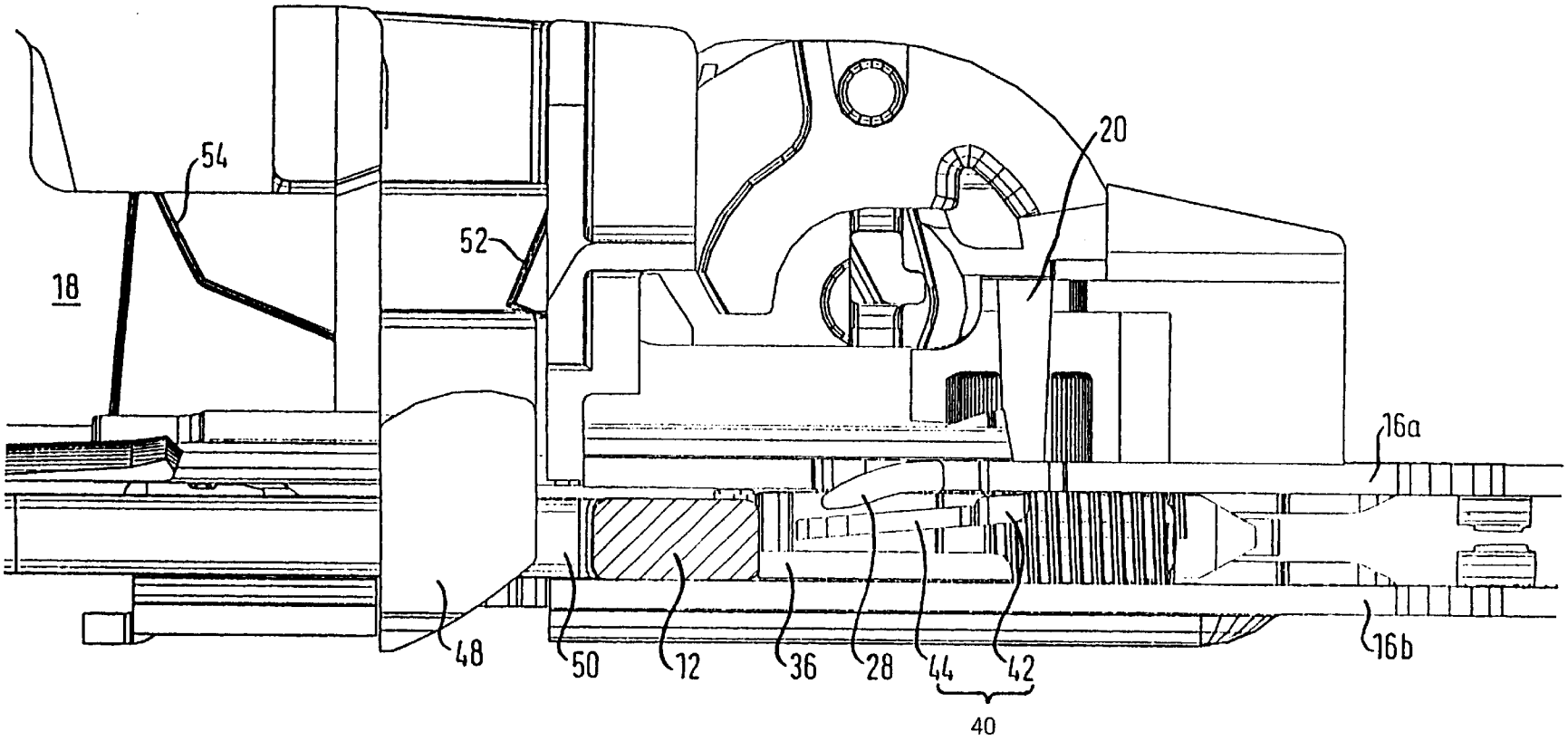

Referring now to FIGS. 4 and 5 there is illustrated a latch 48 provided in the buckle 10 serving to latch the insert tongue 12 in place, the latch 48 being slidably mounted transversely to the direction of movement of the ejector 30 between a release position and a latching position (see FIG. 7). The latch 48 can be released by the release button 18 so that it moves into its latching position in which it engages an opening 50 in the inserted insert tongue 12, the tongue being thereby latched in place in the buckle 10.

Figure 6:
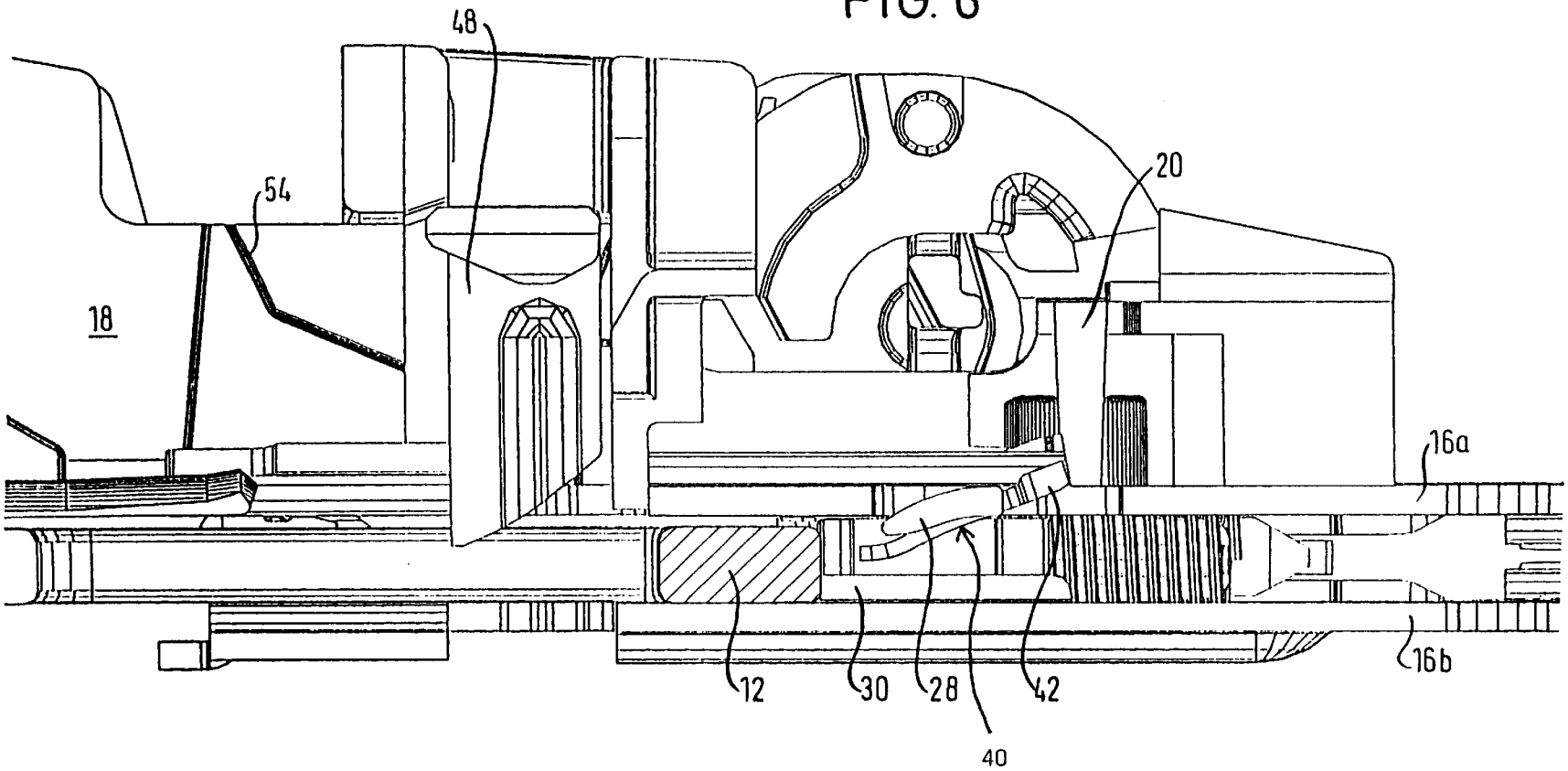

Referring now to FIGS. 4 to 7 the functioning of the buckle 10 will now be described for a normal insertion of the insert tongue 12. The latch 48 is maintained in its release position by a first connecting link 52 (FIG. 7) at the release button 18. The insert tongue 12 is guided into the insertion opening 22 at the front side of the buckle 10. On insertion of the insert tongue 12 it urges the ejector 30 to the rear against the bias from the spring 46, i.e. in the direction of the slaved pin 20 (FIG. 4). In further shifting of the insert tongue 12 the buffer 42 of the pusher 40 slides on the ramp 28 so that the buffer 42 is urged upwards with flexing of the member 44 into the working position (FIG. 5). This results in the buffer 42 coming into contact with the slaved pin 20 so that the ejector 30 is now able to shift the release button 18 to the rear by means of the pusher 40 (FIG. 6). Due to this shift the first connecting link 52 releases the latch 48 so that it is moved into its latching position in which it engages the opening 50 in the insert tongue 12. The length of the ramp 28 is dimensioned so that as soon as the release button 18 has been shifted far enough between the slaved pins 20 to thus release the latch 48, the buffer 42 has attained the rear end of the ramp 28 and thus drops back again into its resting position due to the flexible spring action of the member 44 (FIG. 7).

Figure 8:
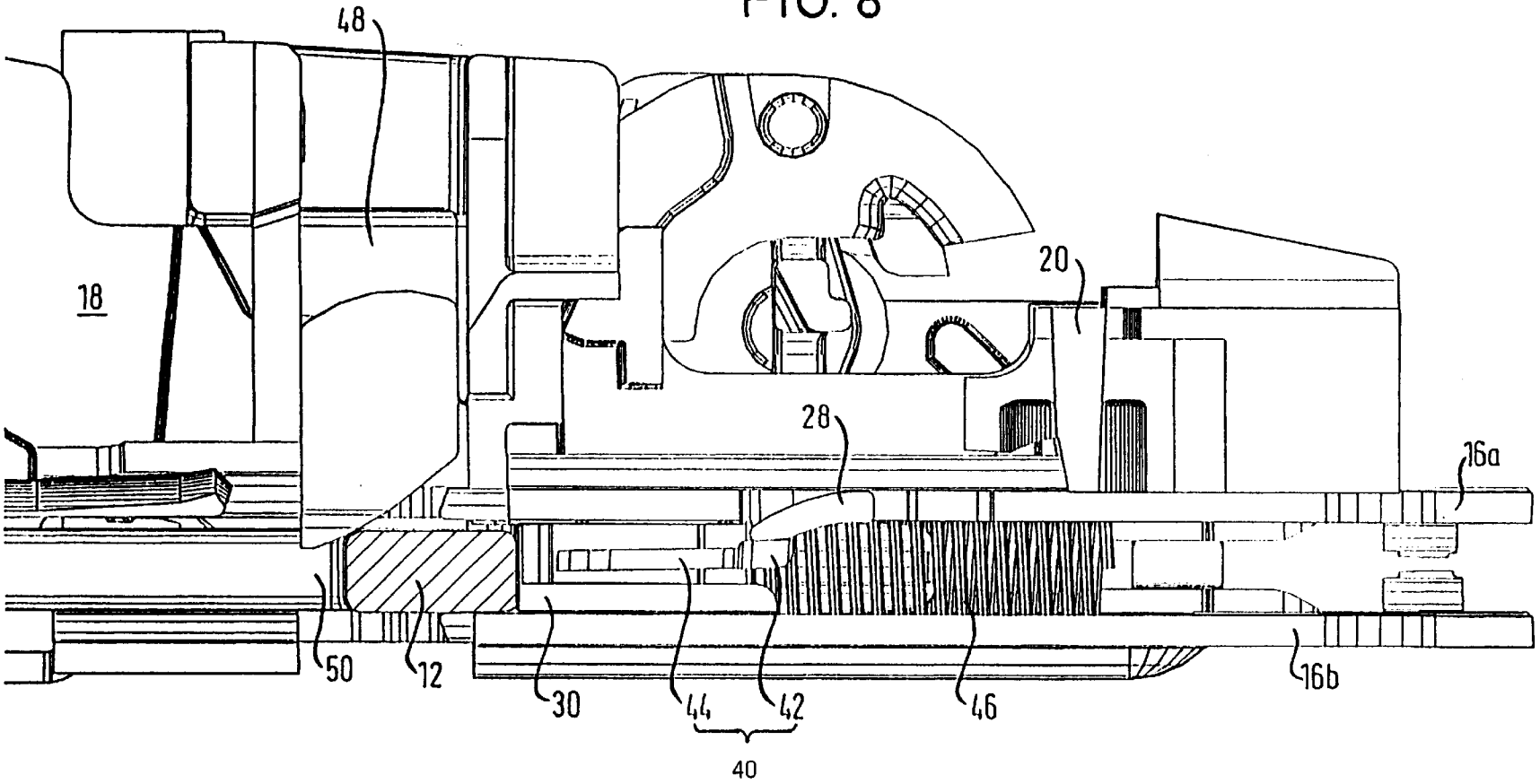
FIG. 8 is a detail on a magnified scale of a cross-section through the buckle as shown in FIG. 1 on release of the insert tongue.

Referring now to FIG. 8, to release the latch the release button 18 needs to be urged to the rear. In this arrangement the latch 48 is shifted by a second connecting link 54 at the release button 18 from its latching position into the release position to thus re-release the insert tongue 12.

Should the buckle 10 be shock loaded from the rear with the insert tongue 12 inserted and latched in place, as happens for instance on activation of a belt tensioner when the buckle 10 impacts a stopper, then both insert tongue 12 and release button 18 are exposed to heavy acceleration. Due to their mass inertia both attempt to move to the rear relative to the frame 16. Because of the aforementioned device 24 the release button 18 is prevented from shifting out of place relative to the frame 16. However, since the insert tongue 12 also comprises a certain clearance relative to the buckle 10, it may happen that the insert tongue is still on the move when the release button 18 is already at rest. But since the pusher 40 is in its resting position the connection between ejector 30 and slaved pins 20 is effectively broken to thus prevent the insert tongue 12—which due to its mass being relatively large as compared to that of the release button 18 has a large impulse—from passing on this impulse to the release button 18 by means of a flexible jolt via the ejector 30.

Now, the pusher 40 cannot be returned to its working position until the buffer 42 has been moved under the ramp 28 through to the front end thereof. The length of the pusher 40 and the position of the ramp 28 on the frame 16 are selected, however, so that this is only possible when the latch 48 has been removed from the opening 50 by the urging of the release button 18 so that the ejector 30 is able to shift the insert tongue 12 in the direction of the insertion opening 22 (FIG. 8).

What is claimed is:

1. A seat belt buckle comprising a release button for a latch slidably mounted on a frame, an ejector for an insert tongue and at least one connecting element, said connecting element being shiftable between a working position, in which it makes a connection between said ejector and said release button, and a resting position in which it breaks said connection between said ejector and release button, a dislocator being provided on said frame, dislocating said connecting element from said resting position into said working position when said ejector is shifted out of place.

2. The buckle of claim 1, wherein said connecting element is biased into said resting position by force of a spring.

3. The buckle of claim 1, wherein said connecting element consists of a shifter formed on said ejector and said dislocator is configured as a ramp on said frame, on which said shifter slides when said ejector is shifted out of place.

4. The buckle of claim 3, wherein the length of said ramp is selected so that at the end of the shifting travel of said ejector said shifter is released from said ramp to fall back into said resting position.

* * * * *